United States Patent [19]

Ritchie

[11] 3,990,819

[45] Nov. 9, 1976

[54] SEALS FOR ROTARY MECHANISMS

[75] Inventor: James A. Ritchie, Peoria Heights, Ill.

[73] Assignee: Caterpillar Tractor Co., Peoria, Ill.

[22] Filed: Sept. 26, 1975

[21] Appl. No.: 616,971

[52] U.S. Cl. ..... 418/91; 418/124

[51] Int. Cl.[2] ..... F04C 27/00; F04C 29/00

[58] Field of Search ..... 418/123, 124, 122, 91, 418/93, 268

[56] References Cited

UNITED STATES PATENTS

| | | | |
|---|---|---|---|
| 3,191,503 | 6/1965 | Fuehrer | 418/266 |
| 3,366,317 | 1/1968 | Keylwert | 418/91 X |
| 3,659,503 | 5/1972 | Ehluss et al. | 418/124 X |
| 3,799,709 | 3/1974 | Reitz et al. | 418/91 |
| 3,881,848 | 5/1975 | Huf | 418/124 X |
| 3,909,158 | 9/1975 | Martin | 418/269 X |

FOREIGN PATENTS OR APPLICATIONS

| | | | |
|---|---|---|---|
| K5,456 | 12/1955 | Germany | 418/175 |

*Primary Examiner*—C. J. Husar
*Assistant Examiner*—Leonard Smith
*Attorney, Agent, or Firm*—Wegner, Stellman, McCord, Wiles & Wood

[57] ABSTRACT

An improved rotary mechanism having a housing defining an operating chamber, a shaft journalled in the housing and extending through the chamber, a rotor journalled on the shaft and within the operating chamber, at least one seal receiving groove in the rotor and a seal within the groove having a surface sealingly engaging the housing. An elastomeric O-ring is disposed within the groove and sealingly engages the sides of the groove. It is also disposed adjacent the seal oppositely from the sealing surface. A conduit is provided for directing fluid under pressure to the interior of the O-ring to cause the same to bias the seal against the housing.

10 Claims, 6 Drawing Figures

SEALS FOR ROTARY MECHANISMS

BACKGROUND OF THE INVENTION

This invention relates to rotary mechanisms such as trochoidal mechanisms, slant axis rotary mechanisms, or the like. More particularly, the invention relates to such mechanisms used as pumps, compressors, engines, or the like and to improved means for biasing rotor carried seals employed in such mechanisms.

Conventionally, energization of seals in engines, pumps, compressors, or the like is accomplished by using the medium to be sealed when under pressure by bleeding a certain portion of the compressed medium to the underside of the seal in a groove to thereby drive the seal out of the groove and into good sealing engagement with a chamber wall. In such mechanisms, the seals must move through the so-called side clearance of the seal before such sealing can take place. Although motion on the order of 0.04 – 0.08 mm is all that is required, during such side shifting, there is a period when the seal is not engaged with the sides of its groove and is, therefore, permitting leakage of the medium.

In reciprocating mechanisms, such leakage is not a serious problem because of short seal length and a resulting relatively small leakage area. However, in rotary mechanisms, it is an important factor because of the much greater relative seal length as compared to a reciprocating mechanism having the same displacement. Thus, there is a need, in rotary mechanisms, for improved means for energizing seals.

SUMMARY OF THE INVENTION

It is the principal object of the invention to provide a new and improved rotary mechanism. More specifically, it is an object of the invention to provide an improved means for energizing seals employed in such mechanisms.

An exemplary embodiment of the invention achieves the foregoing object in a rotary mechanism including a housing defining an operating chamber and having a shaft journalled in the housing and extending through the operating chamber. A rotor is journalled on the shaft within the operating chamber and carries at least one seal receiving groove. A seal is disposed within the groove and has a surface sealingly engaging the housing. An elastomeric O-ring is also disposed within the groove and sealingly engages the sides of the groove. The O-ring is disposed adjacent the seal oppositely from the sealing surface thereof. Means are provided for directing fluid under pressure to the interior of the O-ring to cause the same to bias the seal against the housing to provide improved sealing.

According to one embodiment of the invention, the means for directing fluid under pressure includes a conduit in the rotor opening into the operating chamber to receive the compressed medium therefrom. The conduit may include a check valve so as to maintain energization throughout the mechanism cycle.

In a highly preferred embodiment of the invention, an accumulating chamber is carried by the rotor and is in fluid communication with the conduit between the check valve and the O-ring to minimize pressure variations in energization of the seals.

According to another embodiment of the invention, the directing means includes an oil inlet opening in the groove and adapted to be connected to a source of oil under pressure.

The mechanism may also include an oil outlet in the groove and spaced from the oil inlet whereby oil may be circulated through the groove to bias the seal as well as to cool the same. Typically, when such an approach is employed, the groove, the seal and the O-ring are elongated and the inlet and outlet are at opposite ends of the groove to maximize the cooling effects.

According to still another embodiment of the invention, a spacer may be interposed between the O-ring and the seal to minimize the conductivity of heat to the O-ring to thereby prolong its useful life. The spacer is preferably slotted.

Any of the foregoing embodiments may include shim means adjacent at least one end of the O-ring to preclude chafing thereof.

Other objects and advantages will become apparent from the following specification taken in connection with the accompanying drawings.

DESCRIPTION OF THE PREFERRED EMBODIMENTS

Figure 1:
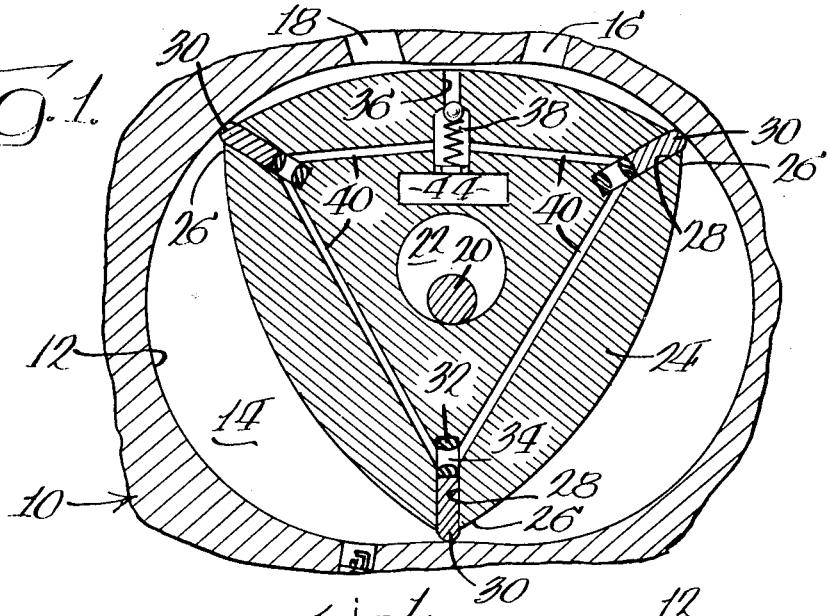
FIG. 1 is a sectional view of one form of a rotary mechanism embodying the invention and taken approximately along the line 1—1 of FIG. 2.

An exemplary embodiment of an improved seal energizing system made according to the invention is illustrated in the drawings and with reference to FIG. 1, is shown in connection with a trochoidal mechanism, specifically, an engine. However, it is to be understood that the invention is not limited to engines or trochoidal mechanisms, but may be advantageously employed in pumps, compressors or the like as well as engines and in other rotary mechanisms, such as slant axis rotary mechanisms.

With reference to FIG. 1, a trochoidal engine having a housing 10 is illustrated. The housing 10 has interior walls 12 and 14 which define an operating chamber. Also provided are intake and exhaust ports 16 and 18, respectively. A shaft 20 is journalled by any suitable means (not shown) in the housing 10 and carries an eccentric 22 which, in turn, journals a rotor 24 within the operating chamber. The rotor 24 has three apices 26 and at each apex, there is disposed an outwardly opening, seal receiving groove 28. Each groove 28, in turn, receives an elongated, apex seal 30 which sealingly engages the wall 12 of the operating chamber.

It is to be noted that the usual side clearance need not be provided according to the invention. That is, in the usual mechanism of the type illustrated, the width of the groove 28 is somewhat greater than the width of the seal 30 so as to allow shifting of the seal within the groove for gas energization. According to the instant invention, such clearance is not necessary, it only being necessary that the groove 28 be sized with respect to the seal 30 such that the seal 30 may freely reciprocate within the groove without binding.

Disposed within each groove 28 in abutment with the innermost side of the seal 30, that is, the side of the seal 30 opposite from its sealing surface in engagement with the wall 12, is an O-ring 32 formed of an elastomeric material. As can be seen in FIGS. 2, 3, 5 and 6, the O-ring 32 is not an O-ring in the most technical sense in that it is not a torus. Thus, as used herein, the term O-ring is intended to encompass any element having an open center whether or not precisely circular.

Each O-ring 32 is preferably of round section and of a width so that when received within a corresponding one of the grooves 28, it will sealingly engage the sides of the groove. Consequently, the open center 34 of each O-ring 32 in connection with the opposed side walls of each groove 28 define a closed, but expansible chamber.

Means are provided for directing a fluid under pressure to the expansible chamber, i.e., the interior of each O-ring 32. In the embodiment illustrated in FIGS. 1 and 2, the rotor 24 includes a radially outwardly extending conduit 36 which opens to the periphery of the rotor. Within the conduit 36 is a spring loaded check valve 38 which allows fluid under pressure to enter the conduit 36 but precludes the same for exiting the conduit. Peripheral conduits 40 extend from the check valve 38 to ports 42 in the side walls of the grooves 28 in the manner illustrated. Consequently, during operation of the mechanism, when a compression cycle takes place adjacent that portion of the periphery of the rotor 24 having the conduit 36, fluid under pressure will be directed to the expansible chambers at the interior of each O-ring to energize the corresponding seals 30 to bias the same into good sealing engagement with the wall 12 of the operating chamber.

To minimize pressure fluctuations, an accumulating chamber 44 in fluid communication with the check valve 36 may be provided.

Figure 2:
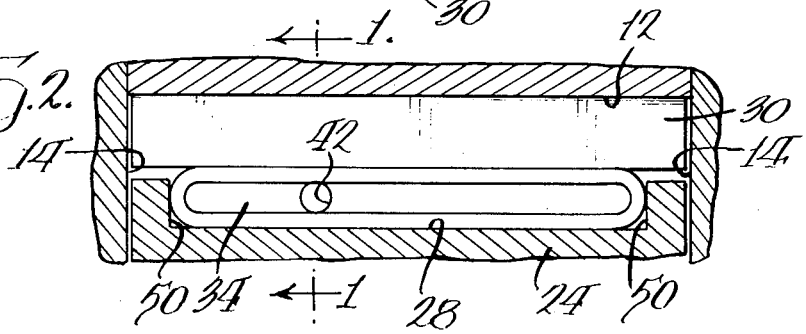
FIG. 2 is an enlarged, fragmentary view of an improved seal energizing means made according to the invention.

In general, it is desirable that each of the grooves 28 be stepped, as illustrated in FIG. 2. Specifically, the lower part of each groove 28 is terminated as at 50 short of the side walls 14 to insure positive retention of the O-ring 32 within the groove. In the case of the seals 30, as is well known, in a trochoidal type mechanism, the same should extend virtually to the side walls 14.

Figure 3:
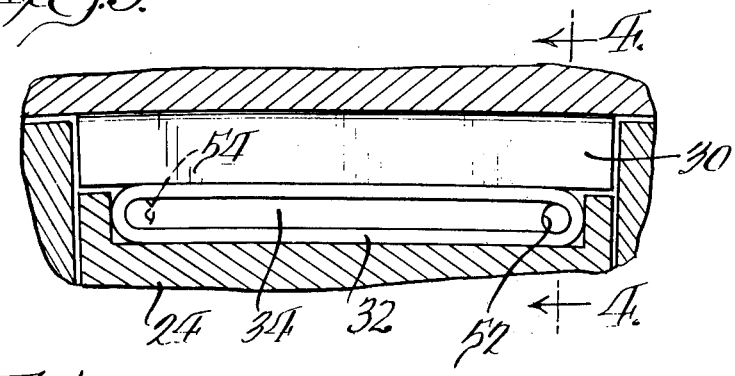
FIG. 3 is an enlarged, fragmentary view of a modified embodiment of the invention.
Figure 4:
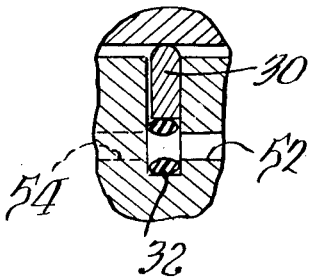
FIG. 4 is a fragmentary sectional view taken approximately along the line 4—4 of FIG. 3.

FIGS. 3 and 4 illustrate a modified embodiment of the invention. Specifically, at one end of the lower portion of the groove 28, there is provided an oil inlet port 52, while at the opposite end, there is provided an oil outlet port. The port 52 is adapted to be connected to a source of oil under pressure. For example, the same may be connected to a radially extending passage fronting on the eccentric 22. Oil under pressure may be supplied through a suitable bore in the shaft 20 and a radial bore in the eccentric 22 for periodic or continual alignment with such a radial passage to provide oil to the interior of the O-ring 32. The oil outlet 54 may be connected by a conduit to the side of the rotor opening radially inwardly of the oil seal to return the oil to the sump. Such a conduit should be provided with a restriction or a pressure regulating valve so that the requisite energizing pressure at the interior of the O-ring 32 will be maintained to provide the desired biasing of the seal 30.

The embodiment illustrated in FIGS. 3 and 4 provides some measure of cooling for the seal 30 by reason of heat rejection to the oil. Thus, the seal 30 will run cooler and with less wear.

Figure 5:
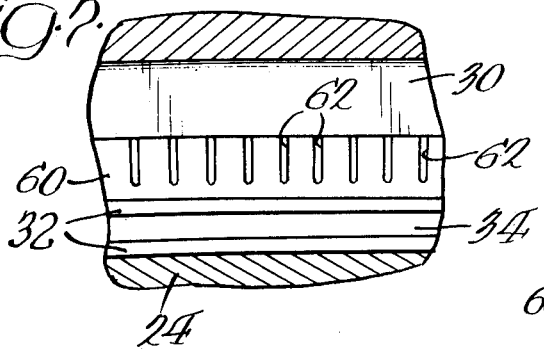
FIG. 5 is an enlarged, fragmentary sectional view of a further modification of the invention.

FIG. 5 illustrates an embodiment of the invention particularly suited for high temperature applications. In the embodiment of FIG. 5, an elongated spacer bar 60 is interposed between the O-ring and the seal 30 to minimize the amount of heat transfer to the O-ring 32. Thus, in situations where heat could damage the O-ring 32, the spacer bar 60 may be employed to minimize the problems.

Preferably, the spacer bar 60 is slotted as at 62 to minimize its rigidity, thereby allowing the energization of the seal 30 to be more uniform, notwithstanding distortions caused by heat or pressure.

Figure 6:
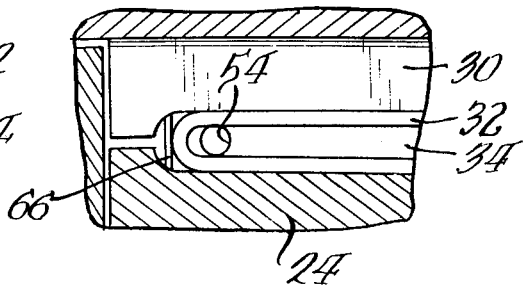
FIG. 6 is an enlarged, fragmentary sectional view of a modification that may be employed with any of the previously illustrated embodiments of the invention.

FIG. 6 illustrates a preferred form of the invention which is applicable to the previously described embodiments thereof. During operation of the mechanism, there will be some inevitable relative motion between the seal 30 and its groove 28. This may be caused by thermal distortion of the housing, mechanical deflections in the shafting, bearings, rotor, housing and machining tolerances. Such relative motion may, in some instances, accelerate chafing of the O-ring 32 at its ends where it will tend to squeeze out of the confining space under the seal 30. Thus, to preclude such localized wear or chafing, a shim 66 may be placed at each end of the O-ring.

From the foregoing, it will be appreciated that the invention provides an improved means for energizing seals in rotary mechanisms. While it has been described in connection with apex seals, those skilled in the art will recognize that it is applicable to side seals and peripheral seals as well.

What is claimed is:

1. A rotary mechanism comprising:

a housing defining an operating chamber;

a shaft journalled in said housing and extending through said operating chamber;

a rotor journalled on said shaft within said operating chamber;

at least one seal receiving groove in said rotor;

a seal within said groove and having a surface sealingly engaging said housing;

an elastomeric O-ring within said groove sealingly engaging the sides of the same and being disposed adjacent the seal oppositely from said surface; and means for directing fluid under pressure to the interior of said O-ring to cause the same to bias said seal aganist said housing.

2. The rotary mechanism of claim 1 wherein said directing means includes a conduit in said rotor opening into said operating chamber.

3. The rotary mechanism of claim 2 further including a check valve in said conduit.

4. The rotary mechanism of claim 3 further including an accumulating chamber in said rotor in fluid communication with said conduit between said check valve and said O-ring.

5. The rotary mechanism of claim 1 wherein said directing means includes an oil inlet opening in said groove and adapted to be connected to a source of oil under pressure.

6. The rotary mechanism of claim 5 further including an oil outlet in said groove and spaced from said oil inlet whereby said seal may be biased and cooled by oil.

7. The rotary mechanism of claim 6 wherein said groove, said seal, and said O-ring are elongated and said inlet and outlet are at opposite ends of said groove.

8. The rotary mechanism of claim 1 further including a spacer interposed between said O-ring and said seal.

9. The rotary mechanism of claim 8 wherein said spacer is slotted.

10. The rotary mechanism of claim 1 wherein said groove, said seal and said O-ring are elongated, and further including shim means adjacent at least one end of said O-ring to preclude chafing thereof.

* * * * *